US008082598B2

(12) United States Patent
Simpson

(10) Patent No.: US 8,082,598 B2
(45) Date of Patent: Dec. 27, 2011

(54) UNDERGARMENT, FOR EXAMPLE A PAIR OF PANTIES, ESPECIALLY FOR WOMEN

(75) Inventor: Elisabeth Simpson, Hong Kong (CN)

(73) Assignee: Triumph Intertrade AG, Bad Zurzach (CH)

( * ) Notice: Subject to any disclaimer, the term of this patent is extended or adjusted under 35 U.S.C. 154(b) by 673 days.

(21) Appl. No.: 12/116,227

(22) Filed: May 7, 2008

(65) Prior Publication Data

US 2008/0282451 A1 Nov. 20, 2008

(30) Foreign Application Priority Data

May 7, 2007 (DE) ..... 20 2007 006 695 U

(51) Int. Cl.
*A41B 9/04* (2006.01)

(52) U.S. Cl. ..... 2/406; 2/400

(58) Field of Classification Search ..... 2/400–406, 2/228, 238; 604/385.01–402
See application file for complete search history.

(56) References Cited

U.S. PATENT DOCUMENTS 4,908,247 A * 3/1990 Baird et al. ..... 428/34.9
6,572,575 B1 * 6/2003 Shimada et al. ..... 604/385.01

* cited by examiner

*Primary Examiner* — Gloria Hale
(74) *Attorney, Agent, or Firm* — Muncy, Geissler, Olds & Lowe, PLLC

(57) ABSTRACT

An undergarment is provided, e.g., a slip, especially for women. The undergarment includes a blank made of a textile material with edgings at the waist and the leg openings, wherein in each case the edgings comprise a flat, two-layered tubular elastic band, which is fastened with an adhesive layer to the left side of the textile material of the undergarment, facing the body. In addition, the invention comprises a process for producing such an undergarment.

7 Claims, 2 Drawing Sheets

UNDERGARMENT, FOR EXAMPLE A PAIR OF PANTIES, ESPECIALLY FOR WOMEN

This nonprovisional application claims priority under 35 U.S.C. §119(a) to German Patent Application No. 20 2007 006 695.3, which was filed in Germany on May 7, 2007, and which is herein incorporated by reference.

BACKGROUND OF THE INVENTION

1. Field of the Invention

The invention relates to an undergarment, for example a pair of panties, especially for women, made of a blank cut from textile material with edgings at the waistband and leg openings.

2. Description of the Background Art

Undergarments of this type, for example panties, usually include a one-piece or multi-piece blank cut from a textile material, wherein the edges of the blank must be bordered especially at the upper edge—the so-called waistband—and the leg openings. These edgings, for example a seam, are not only necessary to provide a finished edge that is resistant to raveling, but also to achieve elastic fitting of the panties to the body.

Known edgings of this type are achieved by folding over the edges and attaching elastic bands, wherein the connection of the parts usually takes place using seams made with thread. Edge folds with sewed seams not only increase the thickness of the material in these areas, so that they become noticeable especially under close-fitting clothing, but often lead to skin irritations. If thicker bands are used, into which the threads can sink, the edge fastenings are all the more noticeable under close-fitting clothing.

To avoid the annoying thickness of such edgings, it is also known to achieve edgings without folds by simply adhering or welding the textile material with the elastic bands. In this case, however, the raw edges of the textile blanks look unattractive. When an attempt is made to avoid the raw edges by means of folds, once again the thickness of the edgings increases, leading to unwanted visibility of the seams under close-fitting clothing.

In addition it is frequently observed as a disadvantage that especially the waistband, because of its width, on adhesion or welding with an elastic band, tends to undergo cross-sectional curvature when the panties are worn, since tension in the circumferential direction causes the elastic material to sink somewhat deeper into the body surface in the area of the longitudinal axis of the elastic band.

SUMMARY OF THE INVENTION

It is therefore an object of the present invention to provide a possibility for creating an edge fastening of the initially mentioned type, by means of which the drawbacks described above are eliminated.

The basic concept of the invention includes using, for accomplishing the edging on such an article of underclothing at the waistband or leg opening, a flat, tubular elastic band, which is fastened by means of an adhesive layer to the side of the textile material of the undergarment facing the body. It is seen as particularly advantageous in this process that the tubular elastic band is connected by the adhesive layer to the textile material only via its outer layer adjacent to this [material] and farther from the body.

Through the use of an adhesive layer for connecting the individual parts, it is possible to dispense with seams sewn with thread, so that any skin irritations can be avoided. Connection of the parts with one another can be achieved by a welded seam, especially by ultrasonic welding.

It is essential for the invention that the superficial connection of the tubular elastic band with the textile material by means of an adhesive layer take place only between the outer layer, remote from the body and adjacent to the textile material. This leads to the fact that the tubular structure of the elastic band is retained in its final state, so that when the undergarment is worn, at most the inner layer of the tubular elastic band adjacent to the body fits against the body with curvature in the transverse direction, whereas the outer layer of the tubular elastic band connected with the textile material via the adhesive layer remains flat. Thus no constriction is recognizable from the outside.

To ensure that actually only the outer layer of the tubular elastic band is connected with the textile material of the blank during the bonding, it is advantageous to give this outer layer of the tubular band a denser structure, thus avoiding penetration of the adhesive. The inner layer adjacent to the body can then be made somewhat looser, so that it lies softly against the skin.

An additional object of the invention is the process for producing an edging on an undergarment.

By means of this process, in which after edge-matched arrangement of the parts to be connected, namely the tubular elastic band with adhesive layer, especially with an adhesive strip and the textile material of the blank, connection takes place through a weld seam, especially an ultrasonic weld seam, and the tubular elastic band is folded over with the adhesive strip around this weld seam in the inside position necessary for the final state, a completely smooth external appearance of the undergarment is achieved at the edgings, and overall a very flat appearance, which is not visible even under close-fitting clothing.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Based on the drawings, the invention will be explained using the example of a pair of panties, but without the application area of the invention having to be limited to such an undergarment for women. However, the edging of an undergarment in accordance with the invention can also be applied to comparable applications in items of underclothing for men and children as well.

Figure 1:
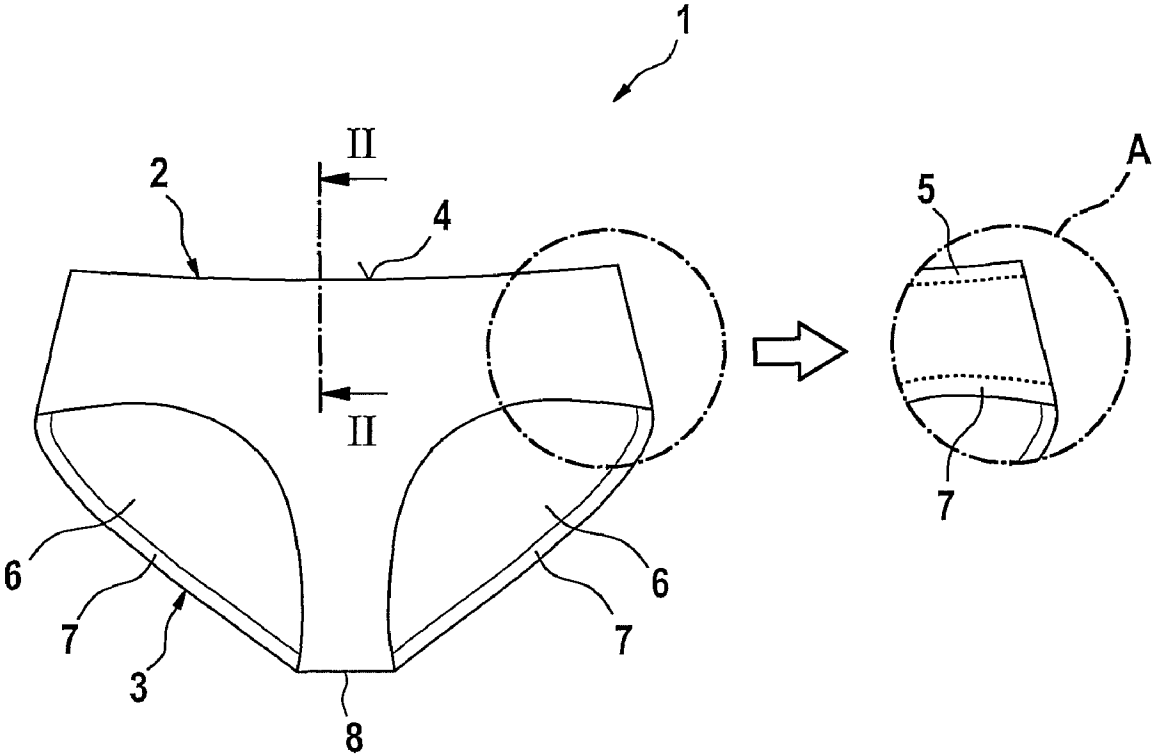
FIG. 1 is a front view of a pair of panties according to the invention.

The pair of panties 1, as shown in the front view in FIG. 1, includes a front piece 2 and a back piece 3. Advantageously the two pieces include a single blank made of a suitable textile material, wherein the two ends of the blank are connected together in a back seam, not shown. At the upper edge 4 of the pair of panties 1 is an edging in the form of a waistband 5; correspondingly, the leg openings 6 are fastened by edgings 7. In the area of the gusset 8 is a seam similar to that in the back area. These seams are not objects of the invention.

Figure 2:
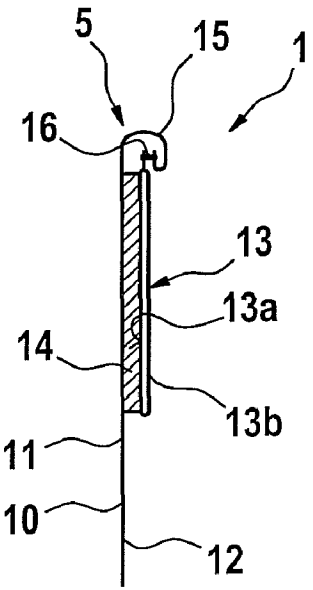
FIG. 2 is a cross section through the edging in the area of the waistband.

Whereas the edgings at the waistband 5 and at the leg opening 6 are indicated in a detail A, FIG. 2 shows a cross section through the waistband 5 along the line II-II n FIG. 1. On the outside of the panties 1 is the textile material 10 forming the blank, the right side 11 of which forms the outside, facing away from the body, and the left side 12 the inside, facing toward the body. The waistband 5 itself is formed by a flat, tubular elastic band 13, the outer layer of which 13*a* is connected by an adhesive layer 14, for example an adhesive strip, with the textile material 10. The inner layer 13*b* is adjacent to the body. An edge fold 15 covers, at least toward the outside, a weld seam 16, by means of which the elastic band 13 is connected with the outer edge of the textile material 10. The manner in which this embodiment of the edging at the waistband 5 can be created will be described in the following based on the drawings in FIG. 3.

Figure 3:
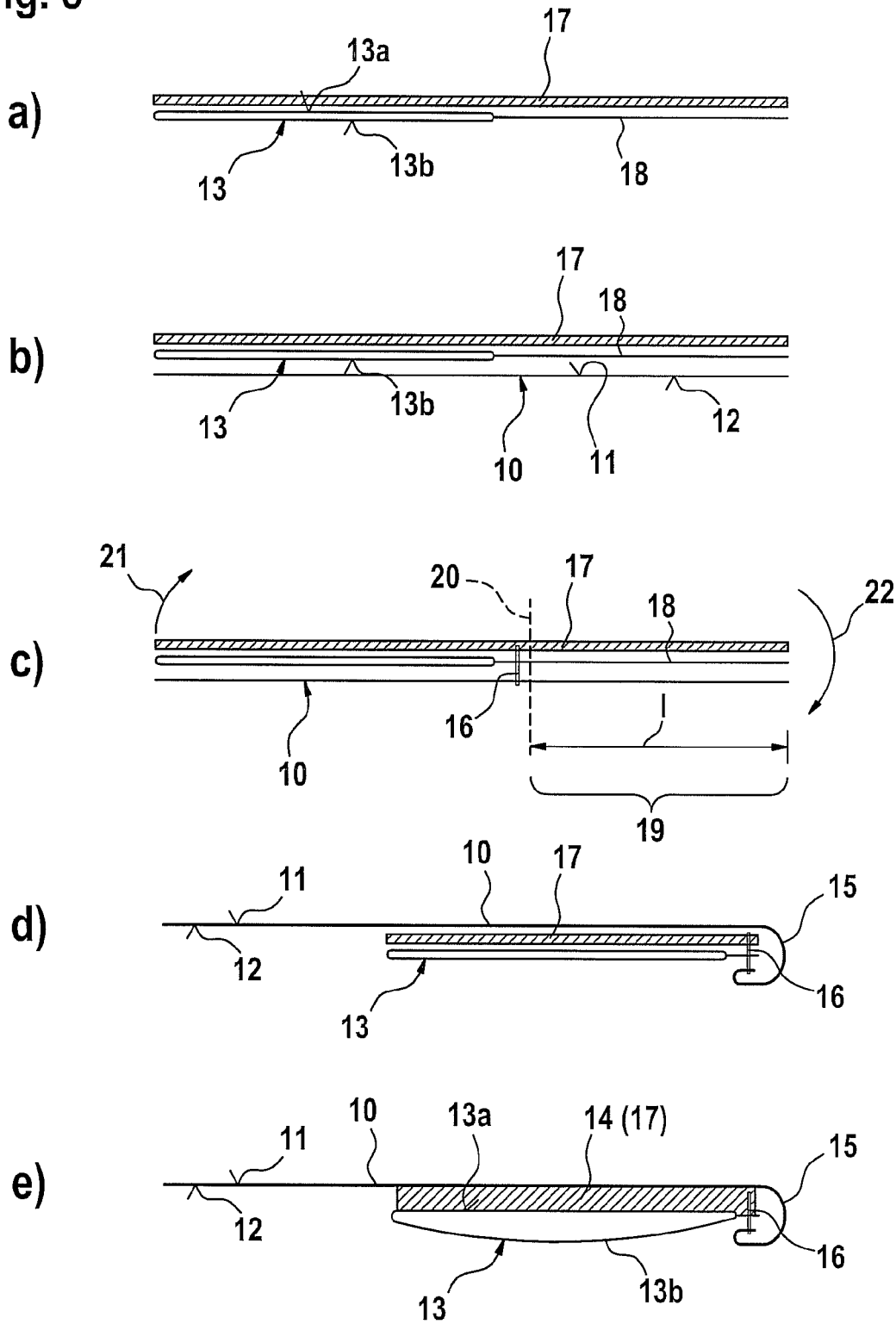
FIGS. 3*a-e* are section drawings, comparable to FIG. 2, of successive working steps in the preparation of an edging in accordance with the invention.

FIG. 3 shows, in sectional views of a number of process steps, the procedure in the manufacturing of an edge design on a pair of panties according to the invention.

FIG. 3*a* shows, as the first step, how an adhesive strip 17 equipped with a thermosensitive adhesive is applied to a flat, tubular elastic band 13, later forming the adhesive layer 14 for connecting the band 13 with the textile material 10. The tubular elastic band 13 on one hand has a single-layer continuation 18 which, as will be explained in the following, serves for easier handling.

As FIG. 3*b* shows, in an additional process step the combination of the elastic, tubular band 13 with single-layer projection 18 and the adhesive strip 17 is placed on the textile material 10 of the blank, specifically in such a way that the right side of the elastic band 13 comes to lie on the right side 11 of the textile material 10.

An essential step in the manufacturing is shown in FIG. 3*c*. This drawing indicates how the parts that are in contact, namely the textile material 10, the tubular band 13 and the adhesive strip 17 are connected together, for example at the point at which the double-layer area of the tubular band 13 passes into the single-layer area 18, by a weld seam 16, for example an ultrasonic weld. Subsequently the edge areas 19 of length l projecting over the weld seam 16 are removed along a cut edge 20.

By wrapping the tubular elastic band 13 with the adhesive strip 17, as indicated by the arrows 21 and 22, the situation shown in FIG. 3*d* is achieved, in which the tubular elastic band 13 in contact with the adhesive strip 17 lies beneath the textile material 10, in other words, within the textile material 10 forming the visible side. In this process the adhesive strip 17 is between the tubular elastic band 13 and the textile material 10 of the blank.

In this condition the adhesive layer 14 arranged on the adhesive strip 17 is activated, so that the final state shown in FIG. 3*e* is achieved. Upon activation of the adhesive by application of pressure and/or heat, intensive adhesion of the adjacent parts takes place. It is possible to see here how the outer layer 13*a* of the tubular elastic band 13 is connected over the adhesive layer 14 with the left side 12 of the textile material 10, whereas the inner layer 13*b* of the tubular elastic band 13 is free, to follow any indentations during fitting against the body.

In this connection it should also be noted that it may be reasonable to produce the outer layer 13*a* of the tubular elastic band 13 with a somewhat denser structure of the fabric or knit to prevent penetration of the adhesive through the outer layer 13*a* during activation and also fixing the inner layer 13*b*. In that case the inner layer 13*b* may include a thinner, more open and correspondingly softer woven or knit fabric to prevent any skin irritation.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An undergarment for women made of a blank of textile material with edging at a waistband and leg openings, the edging comprising a flattened tubular elastic band having opposing inner and outer layers, which outer layer has an outer surface fastened by an adhesive layer to a surface of the textile material of the undergarment facing a body of the wearer, with said inner layer fitting against the body of the wearer when said undergarment is worn.

2. The undergarment in accordance with claim 1, wherein the flattened tubular elastic band is connected with the textile material by the adhesive layer only at the outer surface of the outer layer.

3. The undergarment in accordance with claim 1, wherein the outer layer of the flattened tubular elastic band has a denser structure than the inner layer of the flattened tubular elastic band.

4. The undergarment in accordance with claim 1, wherein the adhesive layer includes a thermosensitive material that is activated by applying pressure and/or heat.

5. The undergarment in accordance with claim 4, wherein the adhesive layer is applied directly to an edge area of the leg openings and the waistband of the blank.

6. The undergarment in accordance with claim 4, wherein the adhesive layer is applied to an adhesive strip, said adhesive strip being placed between the flattened tubular elastic band and the textile material to connect them together.

7. The undergarment in accordance with claim 1, wherein the flattened tubular elastic band is fixed with the textile material of the blank by a weld seam at a free edge of the waistband or the leg openings of the blank.

* * * * *